United States Patent [19]

Rainey

[11] Patent Number: 4,671,393

[45] Date of Patent: Jun. 9, 1987

[54] MAT FOLDABLE INTO AN INSULATED BAG

[76] Inventor: Robert D. Rainey, P.O. Box 676, Aromas, Calif. 95004

[21] Appl. No.: 845,995

[22] Filed: Mar. 31, 1986

[51] Int. Cl.[4] ..... A45C 9/00; A45C 13/10

[52] U.S. Cl. ..... 190/1; 190/2; 190/8; 190/125; 190/901; 5/417; 5/420; 383/4; 383/93; 383/110; 383/111; 383/902

[58] Field of Search ..... 190/1, 2, 8, 125, 901; 383/4, 111, 93, 902, 110; 5/417–420

[56] References Cited

U.S. PATENT DOCUMENTS

| | | | |
|---|---|---|---|
| 2,531,501 | 11/1950 | Cline | 190/1 X |
| 2,865,433 | 12/1958 | Warner | 190/8 X |
| 3,143,748 | 8/1964 | Manning | 383/4 X |
| 3,489,194 | 1/1970 | Hoover | 383/4 |
| 3,763,972 | 10/1973 | Karzmar | 190/8 |
| 4,197,891 | 4/1980 | Comollo | 383/4 |
| 4,210,244 | 7/1980 | Westrick | 206/548 X |
| 4,212,377 | 7/1980 | Weinreb | 190/111 |
| 4,301,898 | 11/1981 | Plough et al. | 190/109 X |
| 4,468,810 | 8/1984 | Longo | 5/417 X |
| 4,499,999 | 2/1985 | Behar | 206/456 |

FOREIGN PATENT DOCUMENTS

| | | | |
|---|---|---|---|
| 1452648 | 9/1966 | France | 190/111 |
| 2478972 | 10/1981 | France | 190/1 |
| 2061712 | 5/1981 | United Kingdom | 190/2 |

*Primary Examiner*—George E. Lowrance
*Assistant Examiner*—Sue A. Weaver

[57] ABSTRACT

A waterproof equipment carrying bag consisting of an outer unit and an inner unit which when unfolded convert into mats. Additionally the mats can be secured to each other by means of Velcro strips to create a longer mat. Nylon webbing sewn to the covering of the outer unit comprise a carrying handle and provide structural support when in the carrying or bag mode.

2 Claims, 7 Drawing Figures

MAT FOLDABLE INTO AN INSULATED BAG

BACKGROUND

Competitive shooters, varmint shooters, picnickers, and nature photographers require equipment and accessories to be carried to various outdoor locations and also must spend time sitting or lying on the ground to accomplish their intended purposes, i.e., competitions, hunting, taking pictures, etc. These activities generally require many trips carrying equipment, blankets, mats, and supplies from the person's vehicle to the intended location of the proposed activity.

SUMMARY

The present invention avoids the above stated dilemma by providing a specifically designed bag for these intents. Instead of carrying a blanket, foam mat, or plastic sheeting to lie or sit upon, one can with this device load peripheral equipment into the Carrymat, carry the mat and equipment to the site, open the Carrymat, remove and set up the equipment, and have a full length mat on which to more comfortably pursue one's endeavors. Another feature of the Carrymat in its closed configuration is its ability to pad the enclosed equipment preventing minor bumping from damaging the enclosed devices.

DETAILED DESCRIPTION OF THE PREFERRED EMBODIMENTS

Figure 1:
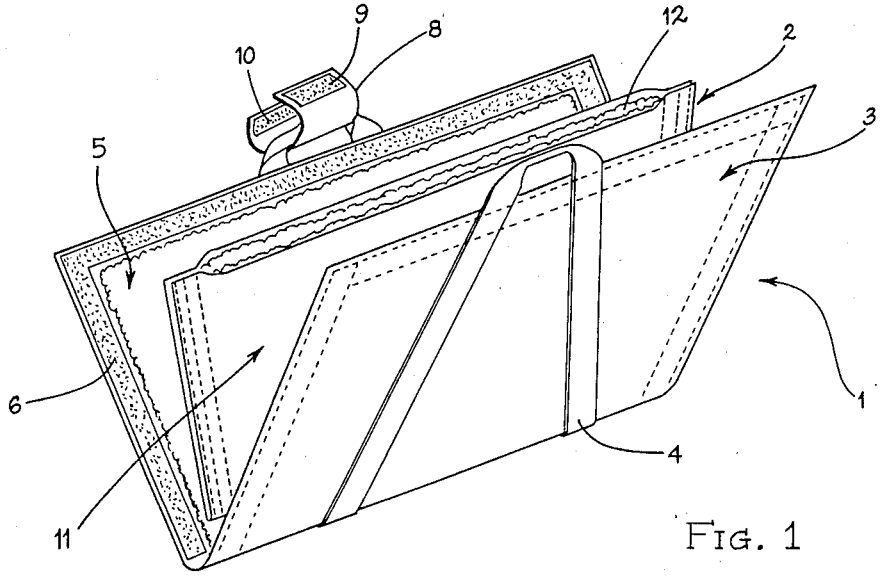
FIG. 1 is a perspective view of the bag partially opened showing the two components.

The bag of the instant invention FIG. 1 has an outside body 1 which encloses an inner pouch 2. The outside body has an outer covering of Cordura nylon 3 to which is sewn a carrying strap of nylon webbing 4. The carrying strap is folded over and stitched to better fit the hand in the looped portions rising above the top horizontal line (edge) of the outer bag 1 wherein is stitched a naugahyde flap B which can be inserted through the opposing looped portion of the carrying strap and secured to itself utilizing opposing Velcro strips 9 and 10, thus further securing the outer bag 1 in the closed position.

The outer bag 1 is constructed of an outer layer of Cordura nylon 3, a middle layer of a closed cell foam 15, and an inner layer of synthetic fleece-like material 5. The layers are stitched together on the outer edges with Velcro on all four inner facing edges 6, 7, so placed to mate in the closed position thus sealing the bag closed. The hooked Velcro 6 is sewn along three sides opposing the three sides of looped Velcro 7.

The inner pouch 2 is constructed of a Cordura nylon outer covering 11, a middle layer of closed cell foam 16, and an inner covering of a synthetic fleece-like material stitched together on two opposing sides with Velcro strips 13, 14, and on the other opposing sides minus Velcro.

Figure 2:
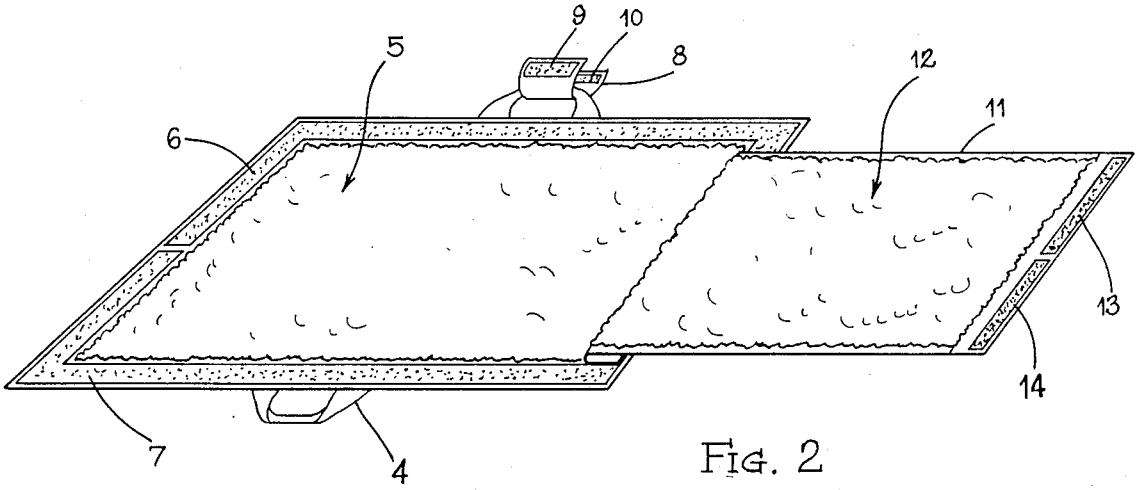
FIG. 2 is a perspective view of the bag assembled in the mat configuration.
Figure 3:
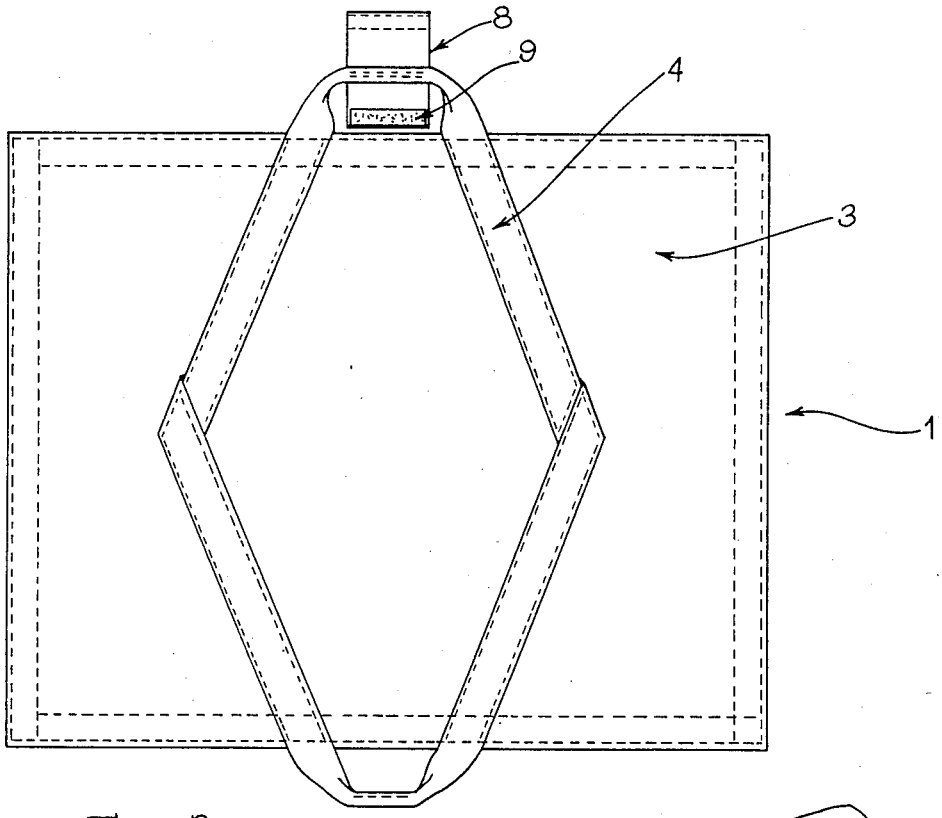
FIG. 3 is a view of the back of the outside bag in the opened position showing the carrying strap construction.
Figure 4:
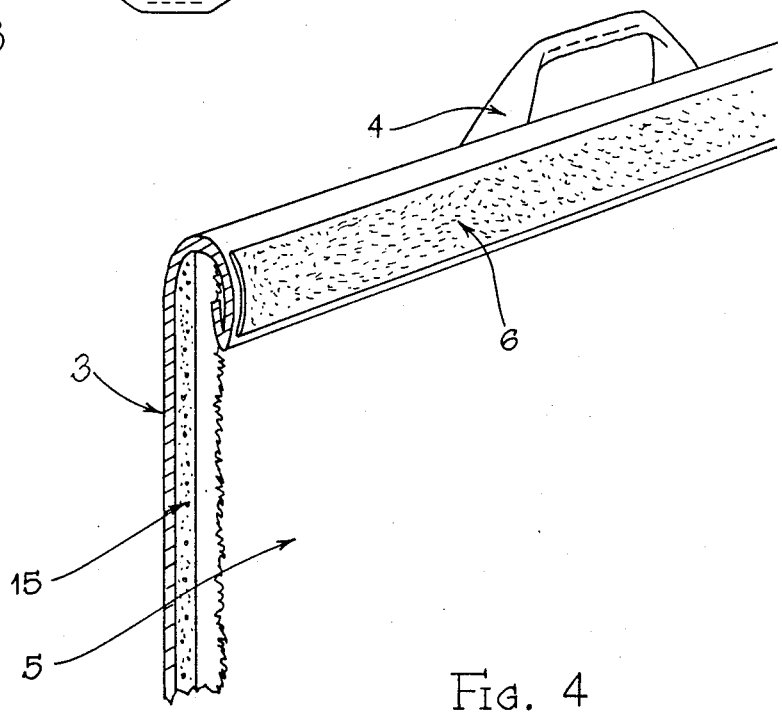
FIG. 4 is a perspective view of the outside bag sectioned to show the construction details.
Figure 5:
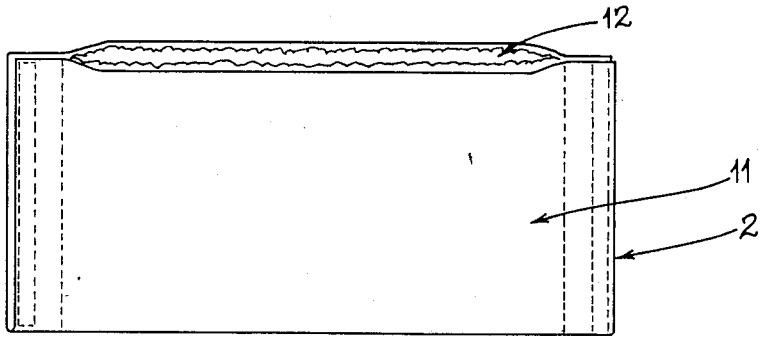
FIG. 5 is a side view of the inner bag.
Figure 6:
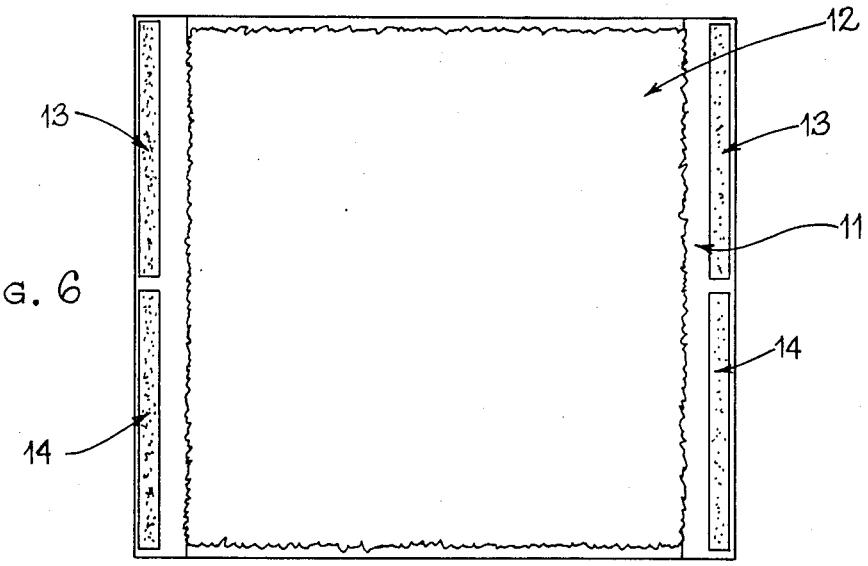
FIG. 6 is a top inside view of the inner bag in the open position.
Figure 7:
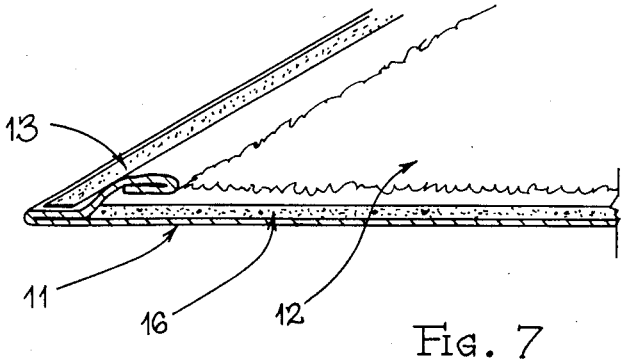
FIG. 7 is a perspective view of the inner bag in partial cross section to show construction details.

The outer bag 1 when opened can be attached to the opened inner pouch 2 by means of folding the Velcro covered edge of the inner pouch under itself and attaching to the matching Velcro strips on the outer bag as per FIG. 2.

I claim:

1. A piece of soft luggage comprising: an elongated flexible bag including means forming two sidewalls when folded or a mat when opened and laid flat; a structurally supportive carrying strap and means attaching said strap to said bag; and a removable pouch including means for joining two ends by Velcro when folded or forming a mat when opened and laid flat; said means forming two sidewalls including a Velcro closure, whereby said removable pouch Velcro can be attached to said Velcro closure to form an enlarged mat.

2. The soft luggage of claim 1, wherein said bag and pouch are formed with insulative and cushioning material.

* * * * *